US010695604B2

(12) United States Patent
Porterfield

(10) Patent No.: US 10,695,604 B2
(45) Date of Patent: Jun. 30, 2020

(54) EXERCISE DEVICE

(71) Applicant: The Porterfield Core Strengthening Device, LLC, Akron, OH (US)

(72) Inventor: James A. Porterfield, Akron, OH (US)

(73) Assignee: Porterfield Core Strengthening Device, LLC, Akron, OH (US)

( * ) Notice: Subject to any disclaimer, the term of this patent is extended or adjusted under 35 U.S.C. 154(b) by 103 days.

(21) Appl. No.: 16/032,790

(22) Filed: Jul. 11, 2018

(65) Prior Publication Data

US 2019/0015696 A1 Jan. 17, 2019

Related U.S. Application Data

(60) Provisional application No. 62/531,408, filed on Jul. 12, 2017.

(51) Int. Cl.

| | |
|---|---|
| ***A63B 21/00*** | (2006.01) |
| ***A63B 21/02*** | (2006.01) |
| ***A63B 21/055*** | (2006.01) |
| ***A63B 23/02*** | (2006.01) |
| *A63B 23/025* | (2006.01) |

(52) U.S. Cl.

CPC .... *A63B 21/4049* (2015.10); *A63B 21/00043* (2013.01); *A63B 21/00185* (2013.01); *A63B 21/023* (2013.01); *A63B 21/055* (2013.01); *A63B 21/4035* (2015.10); *A63B 23/0205* (2013.01); *A63B 23/025* (2013.01); *A63B 23/0233* (2013.01)

(58) Field of Classification Search

CPC ..... A63B 21/4049; A63B 21/055; A63B 21/4035; A63B 21/00043; A63B 21/023; A63B 23/025; A63B 23/0233; A63B 23/0205; A63B 21/02; A63B 21/068; A63B 21/00185–00189; A63B 23/14; A63B 23/16; A63B 21/0004–0004

See application file for complete search history.

(56) References Cited

U.S. PATENT DOCUMENTS 4,461,473 A * 7/1984 Cole ..... A63B 21/0004 482/106
4,618,143 A * 10/1986 Twardosz ..... A63B 21/0724 482/106

(Continued)

*Primary Examiner* — Andrew S Lo
(74) *Attorney, Agent, or Firm* — Jacob M. Ward; Ward Law Office LLC

(57) ABSTRACT

An exercise device has a pair of handles with a resistance assembly connected therebetween. Each handle has an internal annular channel with a stop wall. Each channel receives a grip body and a grip spring that serially abut one another, with the grip spring disposed between the grip body and the stop wall. In use, a user rotates each handle to compress the grip springs and applies tension by bending the resistance assembly. As a result, exercise of the six primary muscle groups responsible for postural stability muscles is provided to the user. Each of the handles are also easily removable from the resistance assembly by way of spring loaded plungers, which allows for different resistance assemblies of different spring force or resistance. The handles are further connected in a nonaligned manner relative to the resistance assembly, which contributes to maximizing the exercising benefits received from the exercise device.

18 Claims, 4 Drawing Sheets

(56) References Cited

U.S. PATENT DOCUMENTS 4,690,400 A * 9/1987 Metz ..... A63B 21/015 482/106
4,702,474 A * 10/1987 Guibert ..... A63B 21/0004 482/126
4,770,409 A 9/1988 Wallisch
4,856,776 A * 8/1989 Ching-Liang ..... A63B 21/045 482/122
5,024,434 A * 6/1991 Smith ..... A63B 21/0724 482/106
5,046,727 A * 9/1991 Wilkinson ..... A63B 21/00043 428/909
5,167,596 A * 12/1992 Ferber ..... A63B 21/0004 482/114
5,941,799 A * 8/1999 Bergdorf ..... A63B 23/14 482/126
6,106,438 A * 8/2000 Dean ..... A63B 23/14 127/45
6,347,892 B1 2/2002 Paddock et al.
6,502,281 B2 1/2003 Faucault et al.
7,094,182 B1 8/2006 Holten
7,862,486 B1 * 1/2011 Watson ..... A63B 21/0724 482/106
D654,544 S * 2/2012 Sliemers ..... A63B 21/0004 D21/662
10,029,140 B2 * 7/2018 Douglass ..... A63B 23/03533
2004/0152571 A1 * 8/2004 Udwin ..... A63B 21/00043 482/128
2011/0041885 A1 * 2/2011 Montgomery ..... A45B 3/00 135/77
2011/0287909 A1 * 11/2011 Morris ..... A63B 21/0004 482/126
2013/0035218 A1 * 2/2013 Wierszewski ..... A63B 21/072 482/106
2014/0038784 A1 * 2/2014 Wallisch ..... A63B 23/14 482/46
2015/0018132 A1 * 1/2015 Lovelace ..... A63B 69/0002 473/458
2017/0080272 A1 3/2017 Bently
2018/0200558 A1 * 7/2018 Alnajjar ..... A63B 23/14

* cited by examiner

EXERCISE DEVICE

CROSS-REFERENCE TO RELATED APPLICATIONS

This application claims the benefit of U.S. Provisional Application No. 62/531,408, filed on Jul. 12, 2017, the entire disclosure of which is hereby incorporated herein by reference.

FIELD

The present disclosure relates to an exercise device and, more particularly, to an exercise device for stabilizing a trunk or a core of a user.

BACKGROUND

The anatomical design of a human trunk or core is key to posture, performance, and prevention of injury/illness/disease. As shown in FIGS. 1-3, a loss of lean body mass 12, coupled with weight gain, particularly in the trunk 14, is known to result in changes in posture and abnormal weight bearing in critical areas of a skeleton 16. Specifically, these critical areas are at a base of a neck 18 (cervicothoracic junction), at a base of a lower back 20 (lumbosacral junction), and at an anterior (front) aspect of a shoulder 22 (impingement).

Over time, such losses and changes in the lean body mass 12 and posture create overload syndromes to the skeleton 16 and related anatomical structures therein. This results in swelling, pain and physical dysfunction. To combat weight gain and loss of physical performance around the trunk area, individuals turn to core exercises to strengthen these muscles. Hence, individuals most often perform multiple different types of exercises, to include all muscles within the abdominal area. This has diverse results and often ineffective for strengthening all portions of the abdominal mechanism.

The abdominal mechanism connects the back part of the neck to the inner thighs of the legs, where the interconnection of muscles and fascia serve to stabilize the trunk that sustains an individual's anti-gravity posture. This interconnection is termed "The Serape Effect," which is symbolized by object 24 in FIG. 2. The shape of the object 24 illustrates that multiple muscle groups throughout the human body 10 work in a flexing manner. Prominently, there are six muscle groups that pull on a central "canvas" 26 of the body 10, which are illustrated in FIG. 3. Specifically, these are pectoralis major (PM), serratus anterior (SA), external oblique (EO), internal oblique (IO), transversus abdominus (TA), and femoral adductors (FA).

Currently, there are many exercise devices available to people who are interested in posture, human performance, and prevention of injury/illness/disease, which are based on torsion. Some of these exercise devices involve springs separated by handles. FIG. 4 illustrates a known exercise device 30, which comprises several springs 32 separated by an attached first handle 34 and an attached second handle 36. A user, not shown, grasps the first handle 34 with one hand and grasps the second handle 36 with the other hand. At that point, the springs 32 hang limply between the two handles 34, 36.

To begin using the exercise device 30, the user stretches his/her arms away from each other, while firmly gripping the handles 34, 36, thereby stretching the springs 32 in an arcing stretched pattern (not shown). At a certain point of extension of the springs 32, the user allows the springs 32 to compress to their initial non-extended position. Typically, this cycle of extension of the springs 32, followed by allowing the springs 32 to compress, is repeated for several repetitions. In so doing, the user's hands and limbs do not cooperate in a manner to exercise all of the primary muscle groups PM, SA, EO, IO, TA, and FA in his/her body, in a coordinated fashion.

There is a continuing need for an exercise device to provide thorough and direct resistance to all of the primary muscle groups PM, SA, EO, IO, TA, and FA, to improve a user's postural stability, along with performance, and provide a more thorough prevention of injury/illness/disease. Desirably, such an exercise device is easy to use and address the movement patterns of standing, sitting, and/or lying positions. The device must further be easily usable in rehabilitation, for outpatients or more debilitated patients who might sit most of a day and primarily use wheel chairs.

SUMMARY

In concordance with the instant disclosure, an exercise device to provide thorough and direct resistance to all of the primary muscle groups PM, SA, EO, IO, TA, and FA, to improve a user's postural stability, along with performance, and provide a more thorough prevention of injury/illness/disease, and which is easy to use and address the movement patterns of standing, sitting, and/or lying positions, and which may be easily usable in rehabilitation, for outpatients or more debilitated patients who might sit most of a day and primarily use wheel chairs, is surprisingly discovered.

In one embodiment, an exercise device or kit for the exercise device includes a pair of handles and a resistance assembly. The pair of handles includes a first handle and a second handle. Each of the first handle and the second handle has an annular grip housing with a top housing portion and a bottom housing portion. The resistance assembly is configured to provide a resistance to bending. The resistance assembly has a first end and a second end. The first end is removably connected to the first handle and the second end removably connected to the second handle. Where provided as a kit, the handles may be separately provided with a plurality of different resistance assemblies.

In another embodiment, each of the top and bottom housing portions has a contoured inner surface. The contoured inner surfaces define an internal annular channel therebetween. The contoured inner surfaces of each of the top and bottom housing portions may have a semi-circular wall. Each of the semi-circular walls may be aligned to define a stop wall within the annular channel. Each of the first handle and the second handle may further have a grip body and a grip spring. The grip body and the grip spring are disposed in the annular channel. The stop wall further has a first side and a second side. The grip spring is disposed between the grip body and the first side of stop wall and normally biases the grip body toward the second side of the stop wall.

In a further embodiment, the grip body has a semi-annular portion, a grip portion, and a bridge portion. The semi-annular portion abuts the grip spring, and the grip portion extends across the diameter of the semi-annular portion. The bridge portion may have a width that is less than a width of the semi-annular portion, and the bridge portion is disposed adjacent the grip spring. The grip spring itself may also have a PTFE coating, which minimizes friction and an associated noise with movement of the grip spring within the annular channel.

In yet another embodiment, the resistance assembly includes a coiled spring and a pair of spring blocks including a first spring block and a second spring block. The first spring block is disposed at a first end of the coiled spring and the second spring block disposed at the second end of the coiled spring. Each of the spring blocks has a first spring block portion and a second spring block portion. The first spring block portion is oriented along a first axis and the second spring block portion oriented along a second axis. The first axis is different from the second axis and together define a nonalignment angle.

The first block portion of each of the spring blocks may further have a pair of spaced apart connection teeth. The bottom housing portion has a cavity containing a plunger spring and a plunger. The plunger spring normally biases the plunger upwardly from the bottom housing in a default position. The plunger is configured to be manually moved to a depressed position by application of a force to the plunger, for example, with a finger of the user, to compress the plunger spring. The cavity is also in communication with a slot further formed in the bottom housing portion. The plunger has spaced apart plunger teeth formed on a side of the plunger.

When plunger is in the default position, one of the plunger teeth is disposed in a gap adjacent the slot. This militates against a movement of the connection teeth of the spring block through the gap. When the plunger is in the depressed position, one of the plunger teeth is disposed in the slot and not in the gap. This permits the movement of the connection teeth of the spring block through the gap. In this manner, each of the handles is selectively secured to the resistance assembly where the plunger is in the default position, and may be removed from the resistance assembly where the plunger is in the depressed position.

In an exemplary embodiment, an exercise device has first and second handles including annular grip housings, and a main resistance object therebetween. The main resistance object may be a spring or a bar that comprises rubber or is rubber-biased. Each grip housing has a top grip housing portion and a bottom grip housing portion. Each of the top and bottom grip housing portions is formed in manner that results in an internal annular channel therebetween when the top and bottom housing portions are assembled together. Each of the top and bottom housing portions further has a semi-circular stop wall formed in its channel, where the semi-circular stop walls are vertically aligned with each other so as to fill an entirety of a cross-section of the annular channel when the top and bottom grip housing portions are assembled to form the handle.

Where assembled to form the handle, each grip housing receives a grip body and a grip spring that serially abut one another on first ends within the annular channel formed within the respective grip housing. Second ends of each grip body and grip spring also abut the vertically aligned top and bottom semi-circular stop, on opposite sides thereof.

As a result, when a user rotates each grip body to cause its respective grip spring to compress, the muscles in each hand and arm are exercised, which results in a conveyance of exercise to other muscles of the body. If concurrently, the user separates his/her arms, then tension in the main resistance object is built up, which results in an additional conveyance of exercise to additional muscles of the body.

In the present disclosure, the resistance assembly is removably attached to each of the first and second handles, so that a multitude of combinations of handles and resistance objects can be realized. Also, the lengths and sizes of the grip bodies and grip springs, the strength of the grip springs, and the friction of internal surfaces of the grip housings can be varied. Hence, the above discussed construction of the instant exercise machine results in providing a multitude of additional conveyances of exercise to the user's major muscle groups.

Consequently, the user experiences complete motion and movement of his/her shoulder blades around the ribcage and across to the midline of the trunk. Thereby, all six of the user's major muscle groups (i.e., PM, SA, EO, IO, TA, and FA) are exercised by thorough and direct resistance to at least these primary muscle groups. This improves a user's postural stability, along with performance, and prevention of injury, illness, or disease.

DRAWINGS

The above, as well as other advantages of the present disclosure, will become readily apparent to those skilled in the art from the following detailed description, particularly when considered in the light of the drawings described hereafter.

Figure 6:
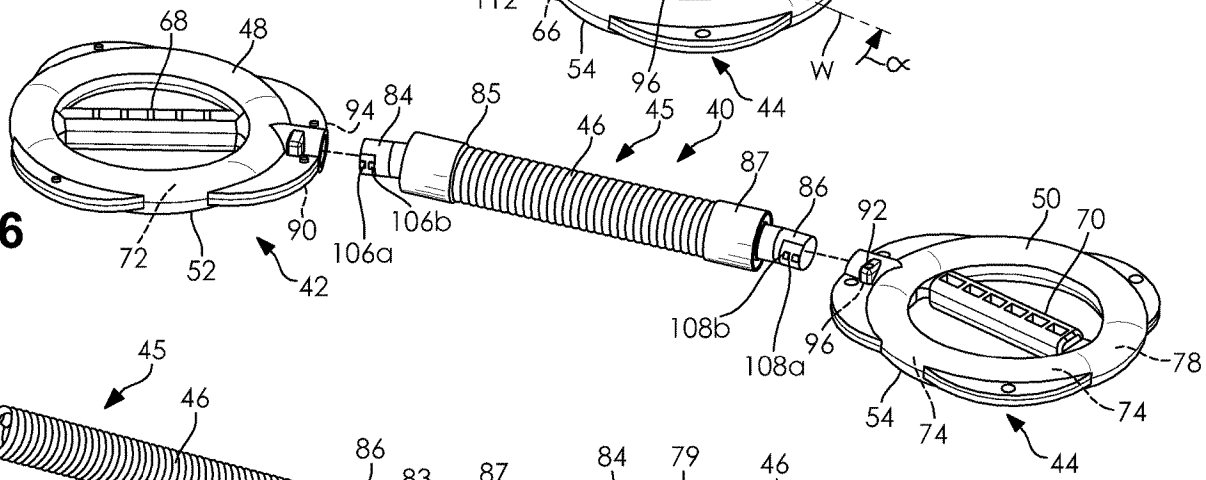
FIG. 6 is a top perspective exploded view of the exercise device shown in FIG. 5, separated into first and second handles or grip assemblies and a main spring assembly.
Figure 7B:
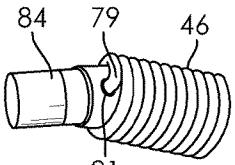
Figure 7A:
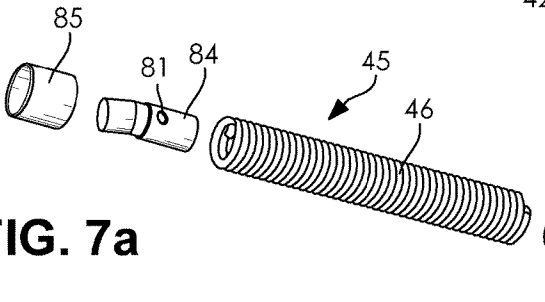
Figure 8A:
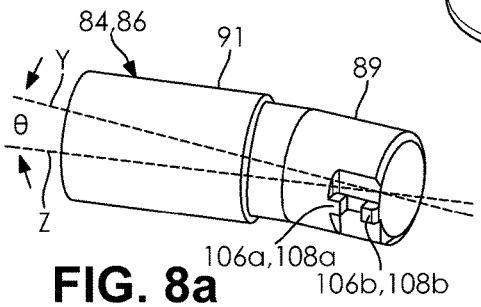
Figure 8B:
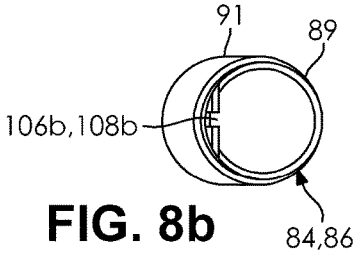

FIG. 7*a* is a top perspective exploded view of the main spring assembly shown in FIG. 6, separated into first and second shrink tubing portions, first and second spring blocks, and a main spring portion;

FIG. 7*b* is an enlarged partial top perspective view of an assembly of the first spring block and the main spring portion shown in FIG. 7*a*, depicted without the first shrink tubing portion and further showing a connection of the main spring portion to the first spring block;

FIG. 8*a* is an enlarged top perspective view of the second spring block rotated to show second spring block connection teeth for selectively connecting the main spring to the second grip housing of the second handle, while showing a nonalignment angle θ between a first portion of the second spring block and a second portion of the second spring block;

FIG. 8*b* is an enlarged side elevational view of the second spring block shown in FIG. 8*a;*

Figure 5:
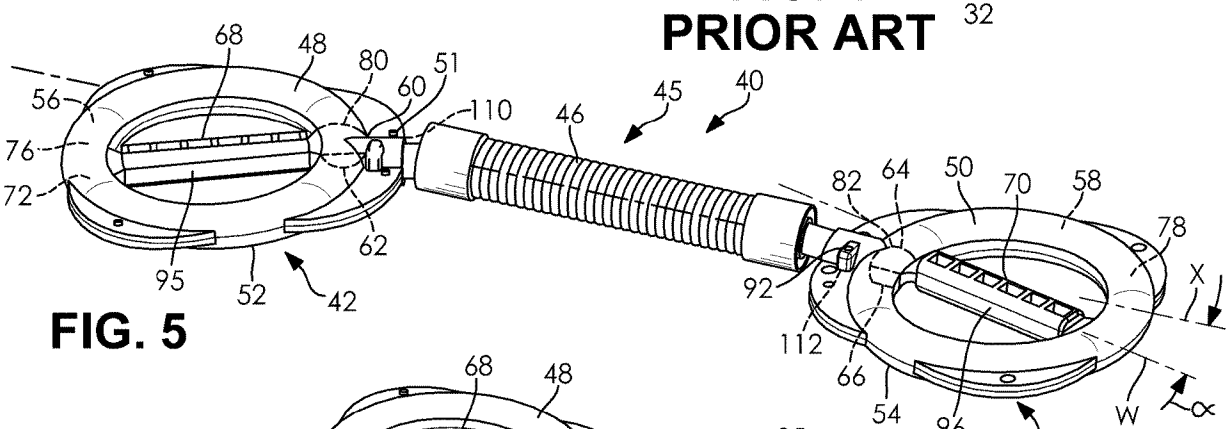
FIG. 5 is a top perspective view of an assembled exercise device according to one embodiment of the present disclosure.
Figure 9A:
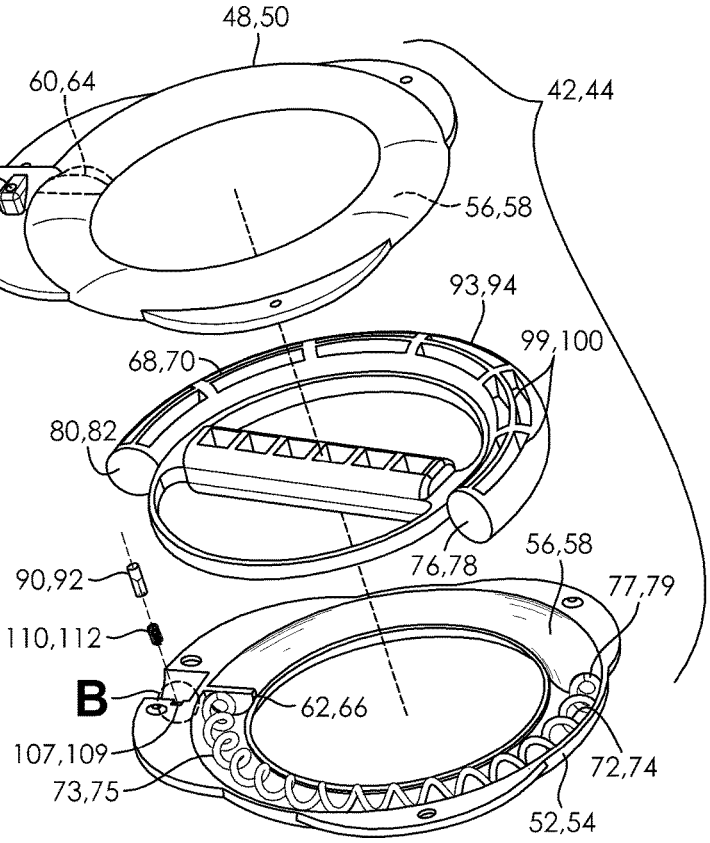
Figure 9B:
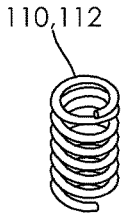

FIG. 9*a* is an exploded top perspective view illustrating an assembly of the second handle shown in FIG. 5;

FIG. 9*b* is an enlarged top perspective view of the plunger spring of the second handle shown in FIG. 9*a;*

Figure 10A:
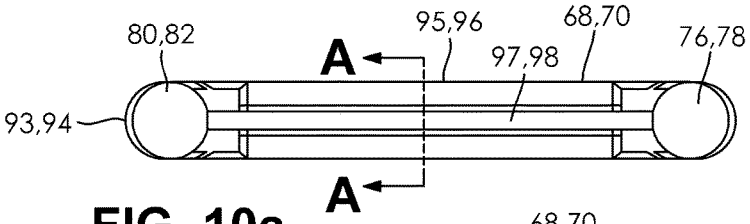

FIG. 10*a* is an enlarged front elevational view of the grip body of the second handle shown in FIG. 9*a;*

Figure 10B:
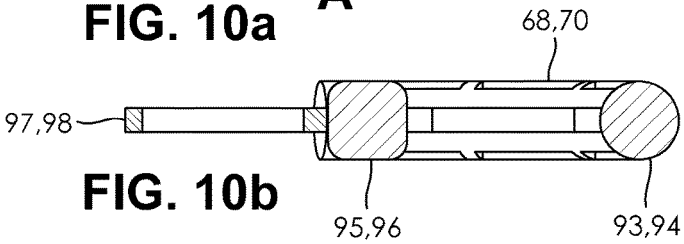

FIG. 10*b* is a cross-sectional side elevational view of the grip body taken at section line A-A in FIG. 10*a;*

Figure 11A:
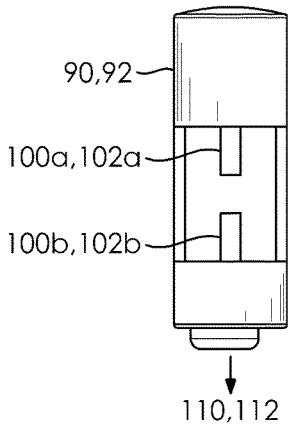

FIG. 11*a* is an enlarged front elevational view of the plunger of the second handle shown in FIG. 9*a;*

Figure 11B:
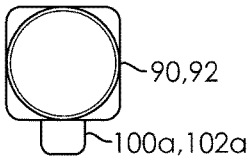

FIG. 11*b* is a top plan view of the plunger shown in FIG. 11*a;*

Figure 11C:
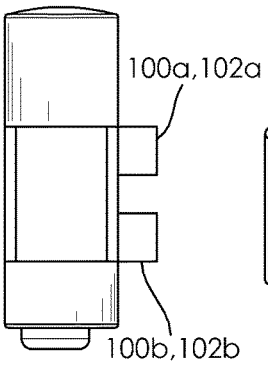

FIG. 11*c* is side elevational view of the plunger shown in FIG. 11*a;*

Figure 11D:
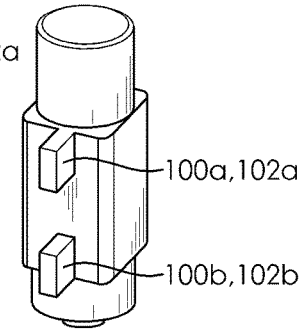

FIG. 11*d* is a top perspective view of the plunger shown in FIG. 11*a;*

Figure 12:
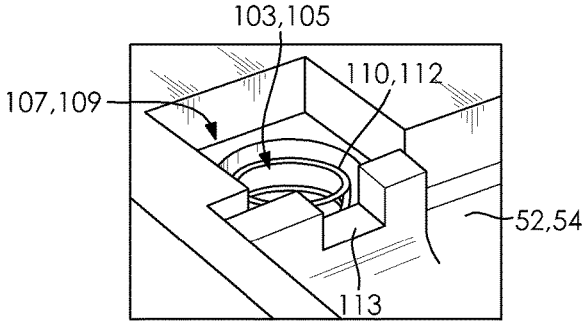
Figure 13:
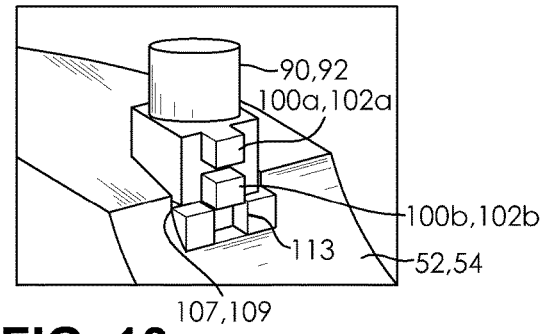
Figure 14:
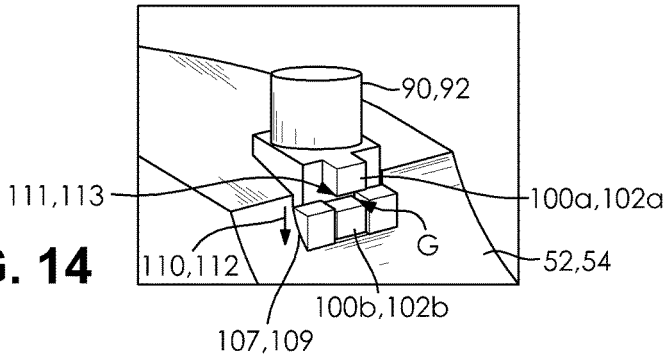

FIG. 12 is an enlarged top perspective view of the plunger hole of the second handle taken at call-out B in FIG. 9*a*, depicted without the plunger being in the plunger hole and further illustrating the plunger spring disposed in the plunger hole;

FIG. 13 is an enlarged top perspective view of the plunger hole of the second handle taken at call-out B in FIG. 9*a*, depicted with the plunger being in the plunger hold and being biased by the plunger spring to a default position; and FIG. 14 is an enlarged top perspective view of the plunger in the plunger hole taken at call-out B in FIG. 13, and further illustrated being manually depressed from the default position to a depressed position by a user pressing the plunger.

DETAILED DESCRIPTION

An exercise device 40 according to one embodiment of the present disclosure is illustrated in FIGS. 5-14. The exercise device 40 has first and second handles 42, 44 that are selectively and removably connected with a resistance assembly 45 therebetween. In particular, the exercise device 40 may be provided as a kit which has the first and second handles 42, 44 and a plurality of different resistance assemblies 45, which may be selectively connected to the handles 42, 44 and employed by the user to provide different levels of resistance, as desired.

The resistance assembly 45 may include a main resistance object such as a coiled spring 46, which is shown here throughout, or a bar (not shown) that comprises rubber or is rubber-biased. In particular examples, the coiled spring 46 is tightly wound steel spring wire of approximately 0.2 inches in diameter. The coiled spring 46 may particularly have one of 41 turns and be about 9 inches in length and about 1.4 includes in outer dimeter (e.g., a main spring—heavy), 47 turns and about 9.2 inches in length and about 1.4 inches in outer diameter (e.g., a main spring—medium), or 51 turns and about 9.2 inches in length and about 1.3 inches in outer diameter (e.g., a main spring—light). One of ordinary skill in the art may select other coil types and configurations, and other suitable resistance objects for the resistance assembly 45, within the scope of the present disclosure.

Each of the first and second handles 42, 44 may include a hollow annular grip housing having a respective top grip housing portion 48, 50 and a bottom grip housing portion 52, 54. The grip housing may be formed from a metal such as aluminum, as a non-limiting example. One of ordinary skill in the art may also select other suitable materials, including resilient polymeric materials, as desired. The top and bottom grip housing portions 48, 50 may be assembled and held together with mechanical fasteners 51 such as bolts, screws, or rivets, or may be heat- or friction-welded together or affixed by any other suitable means.

Each top and bottom housing portion 48, 50, 52, 54 has contoured inner surfaces which define a respective internal annular channel 56, 58 therebetween when respective top grip housing portion 48, 50 is assembled with the bottom housing portions 52, 54 to form the first and second handles 42, 44.

An exemplary handle embodiment is illustrated in FIGS. 9*a*-14, in exploded, enlarged, and cross-sectional views, in order to show internal structure and operation. Although the structure shown in FIGS. 9*a*-14 is described with respect to a singular handle 42, 44, it should be appreciated that the first handle 42 may be the same as or identical in structure and operation as the second handle 44. Thus, the following description relative to the singular second handle 44 applies equally to that of the first handle 42, and reference numbers from both the first and second handles 42, 44 are used accordingly for purpose of simplicity.

As shown in FIGS. 5-6 and 9*a*, the top housing portion 48, 50 of the handle 42, 44 has a respective upper semi-circular stop wall 60, 64 and the bottom housing portion 52, 54 of the handle 42, 44 has a lower semi-circular stop wall 62, 66. The upper and lower stop walls 60, 62, 64, 66 are formed in internal grip annular channels 56, 58 of the top and bottom housing portions 48, 50, 52, 54.

As shown in FIG. 9*a*, a grip body 68, 70 and a grip spring 72, 74 are disposed in a portion of the internal grip annular channel 56, 58 of the handle 42, 44. The grip body 68, 70 may be formed from a resilient polymeric material such as nylon or polyoxymethylene, as non-limiting examples. A skilled artisan may also select other suitable materials for the grip body 68, 70, as desired.

The grip spring 72, 74 may be a steel spring wire with closed ends, for example, and which is resilient and returns to an original length following compression. The grip spring 72, 74 may further have a PTFE jacket (not shown) that minimizes a friction with the contoured surfaces defining the annual channel 56, 58 in operation, which likewise minimizes a noise associated with movement of the grip spring 72, 74 within the annular channel 56, 58. As one non-limiting example, the grip spring 72, 74 may be approximately 0.63 inches in wire diameter, about 8.5 inches in length, and have a PTFE jacket that is approximately 0.007 inches in thickness. Other suitable dimensions and configurations for the grip spring 72, 74 may also be used within the scope of the disclosure.

With reference to FIGS. 10*a* and 10*b*, it should be understood that the grip body 68, 70 has a semi-annular portion 93, 94, a grip portion 95, 96, and a bridge portion 97, 98. The semi-annular portion 93, 94 is slidably received within the annular channel 56, 68, and has a first end 76, 78 and a second end 73, 75. The annular portion 93, 94 may have grooves or recesses 99, 100 formed therein that minimize a weight of the grip body 68, 70 and minimize a friction with the surfaces defining the annular channel 56, 58, and thereby minimize noise and facilitate the sliding of the semi-annular portion 93, 94 within the annual channel 56, 58.

The grip portion 95, 96 is oriented along a diameter of the grip body 68, 70 and is configured to be gripped or held by the end user. The bridge portion 97, 98 is a thin strip of material connecting the first end 76, 78 of the grip body 68, 70 with the second end 80, 82 of the grip body 68, 70. Like the semi-annular portion 93, 94, the bridge portion 97, 98 is received within the annular channel 56, 58. However, the bridge portion 97, 98 is sized to as to accommodate the insertion of the spring 72, 74, and is disposed adjacent to the spring 72, 74 upon assembly.

Upon assembly, first ends 76, 78 of the grip body 68, 70 serially abut first ends 77,79 of the grip spring 72, 74 (see FIGS. 5, 6, and 9*a*) within the annular channel 56, 58 formed within the grip housing 42, 44. Second ends 73, 75 of the grip spring 72, 74 and second ends 80, 82 of the grip body 68, 70 also abut the respective vertically aligned top and bottom semi-circular stop walls 60, 64, 62, 66, on opposite sides thereof. The grip spring 72, 74 normally biases the grip body 68, 70 within the annular channel 56, 58 in this manner, until the user twists or torques the grip portion 95, 96 during use of the exercise device 40, following which the grip body 68, 70 is caused to return to its normally biased position within the annular channel 56, 58.

The upper semi-circular stop wall 60, 64 and the lower semi-circular stop wall 62, 66 are also vertically aligned within the handle 42, 44 upon assembly. As shown in FIG. 5, the locations of the stop walls 60, 62, 64, 66 within the annular channel 56,58 are offset from a longitudinal axis X of the resistance assembly 45. Also, as shown in FIG. 9*a*, a front surface of the grip portion 95, 96 may be disposed on a same plane as a surface of the semi-annular portion 93, 94 defining the second end 80, 82. As shown in FIG. 5, where the second end 80, 82 abuts the stop walls 62, 66 and the grip body 68, 70 is biased fully by the spring 72, 74, the grip portion 95, 96 may be oriented along an axis W that is transverse with the longitudinal axis X. The axis W and the longitudinal axis X together define a grip angle α. Advantageously, and due to the grip angle α, the user's grip is not permitted to extend beyond a mid-range motion during operation of the exercise device 40, which operation is described further hereinbelow. This is believed to militate against undesired strain and injury to the end user in operation.

With renewed reference to FIGS. 5-6, it should be understood that the resistance assembly 45 is selectively and removably attached to the grip housing of each of the handles 42, 44, so that different combinations of handles 42, 44 and resistance assemblies 45 can be realized. In particular, different resistance assemblies 45 having coiled springs 46 with different lengths and sizes may be employed with the handles 42, 44. In certain embodiments, the lengths and sizes of the grip bodies 68, 70 and grip springs 72, 74 may also be varied. The exercise device 40 is thereby made customizable, so that the end user may exercise the user's major muscle groups PM, SA, EO, IO, TA, and FA appropriately regardless of skill level or condition.

To facilitate the selective and removable attachment of the resistance assembly 45 to the handles 42, 44, and as shown in FIG. 6, the resistance assembly 45 may have spring blocks 84, 86 disposed at opposing ends of the resistance assembly 45. Portions of both the coiled spring 46 and the spring blocks 84, 86 may also be covered with protective covers 85, 87, such as rubber or heat shrink covers as non-limiting examples. The protective covers 85, 87 are provided to seal the spring blocks 84, 86 to the ends of the main spring 46, and to militate against a disassembly of the interface between the coiled spring 46 and the spring blocks 84, 86.

As shown in FIG. 7*b*, the connecting interface between the coiled spring 46 and a first one 84 of the spring blocks 84, 86 includes a free end 79 of the coiled spring 46 disposed in a spring block hole 81 formed in an outer surface of the first spring block 84. In particular, the free end 79 of the coiled spring 46 may be bent or hooked so as to be secured with the spring block hole 81 where a portion of the coiled spring 46 adjacent the free end 79 is also disposed over and receives a portion of the spring block 84 itself. For example, the hook of the coiled spring 46 may be about 0.40 inches in length and turned inwardly to the axis X of the coiled spring 46. Other suitable dimensions, shapes, and orientations for the hook at the end of the coiled spring 46 may also be employed. Although not shown, the free end on an opposite side of the coiled spring 46 connects with and is also secured to the second spring block 86 in substantially the same manner into a second spring block hole 83.

With reference to FIGS. 8*a* and 8*b*, a top perspective view of one of the spring block 84, 86 is shown rotated relative to its view in FIG. 7*a* to show spring block connection teeth 108*a*, 108*b* for connecting the main spring 46 to the grip housing of the handle 42, 44. It should be understood that the first spring block 84 has substantially the same structure and functions the same as the second spring block 86, and as such FIGS. 8*a* and 8*b* apply equally to both and are described hereinbelow.

The spring blocks 84, 86 are formed in a manner as to not be axially positioned in-line with the main spring assembly 45 (see FIGS. 7*a*, 7*b*, 8*a*), The second spring block 86 includes a first spring block portion 89 and a second spring block portion 91. The first spring block portion 89 is oriented along a first axis Y, and the second spring block portion 91 is oriented along a second axis Z. Upon assembly with the coiled spring 46, the second axis Z may be coaxial with the longitudinal axis X of the coiled spring, as shown in FIG. 5. The first axis Y is oriented transverse to the second axis Z, and together defines a nonalignment angle θ.

Figure 1:
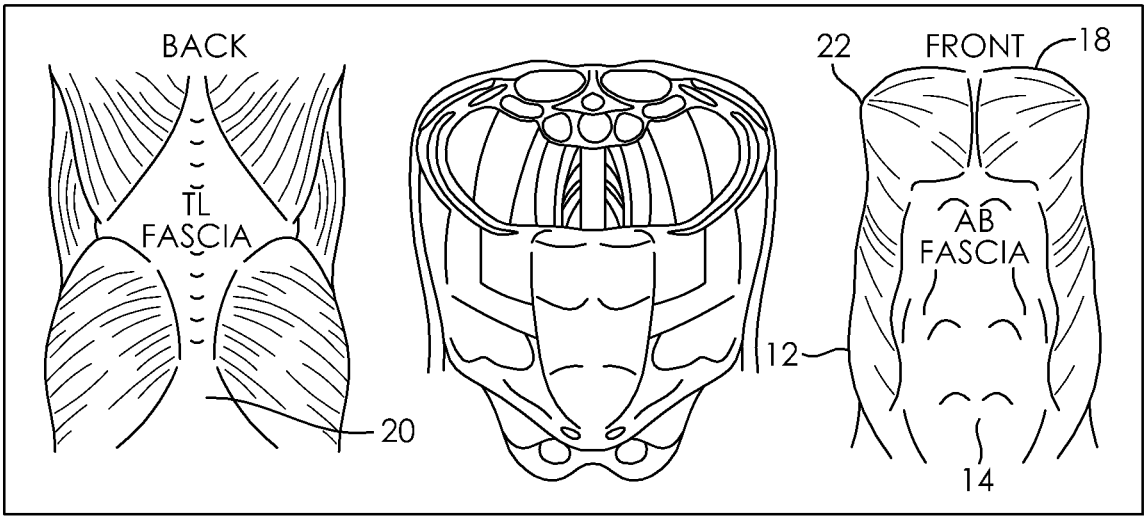
FIG. 1 PRIOR ART
FIG. 1 is a prior art partial elevational view of a human muscular torso, also shown in a front view and a back view to illustrate the thoracolumbar (TL) fascia and the abdominal (AB) fascia.
Figure 2:
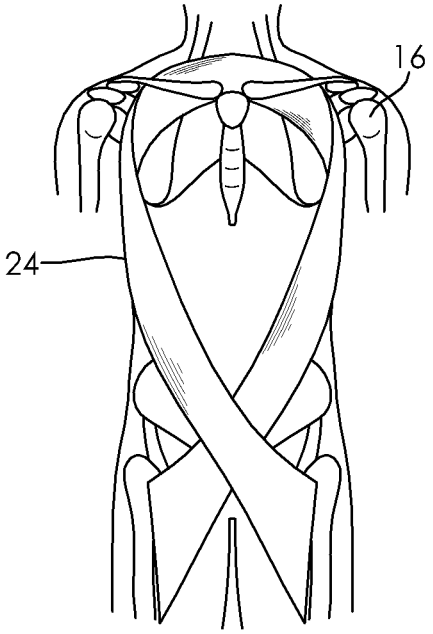
FIG. 2 PRIOR ART
FIG. 2 is a prior art partial elevational view, in the foreground, of "The Serape Effect" object representing the flexibility of a human muscular torso and a prior art elevational view, in the background, of a portion of a human skeleton.
Figure 3:
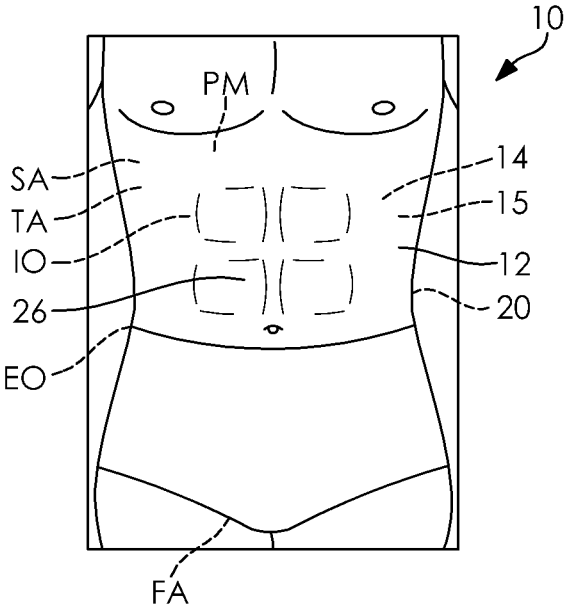
FIG. 3 PRIOR ART
FIG. 3 is a prior art partial front elevational view of an exterior of a human torso.
Figure 4:
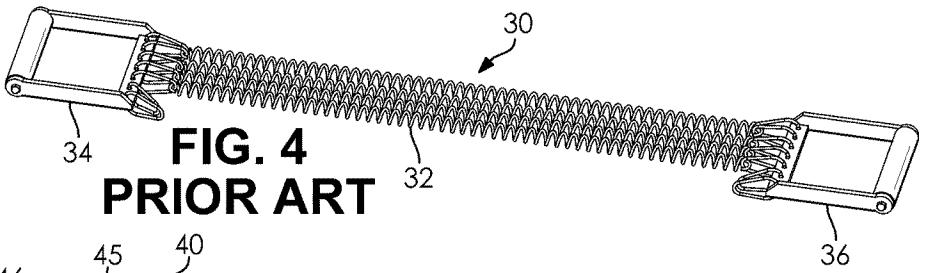
FIG. 4 PRIOR ART
FIG. 4 is a top perspective view of an exercise device according to the prior art.

Advantageously, and in conjunction with the grip angle α described hereinabove, the non-alignment angle θ militates against a user's hands extending beyond a mid-range of motion during operation of the exercise device 40. As a nonlimiting example, the combined grip angle α and non-alignment angle θ may be at least five (5) degrees relative to the longitudinal axis X, in a more particularly embodiment between about five (5) degrees and fifteen (15) degrees relative to the longitudinal axis X, and in a most particular embodiment about ten (10) degrees relative to the longitudinal axis X. One of ordinary skill in the art may also select other suitable grip angles α and non-alignment angles θ, as desired. It should be appreciated that this designed non-aligned positioning assures an arrangement where one of the palms of a user's hands is at most parallel with the general plane of a surface upon which the user stands during the beginning and ending of the exercise motion, and never over-extended. By forcing this particular hand or grip arrangement during the exercise motion, it has been found that the conveyance of exercise to the user's major muscle groups PM, SA, EO, IO, TA, and FA is maximized, as compared to prior art exercise machines like shown in FIG. 4.

With renewed reference to FIGS. 8*a* and 8*b*, the spring blocks 84,86 also provide for easy assembly and disassembly of the resistance assembly 45 to and from the handles 42, 44. Each of the spring blocks 84, 86 has spaced apart first spring block connection teeth 106*a*, 106*b* and spaced apart second spring block connection teeth 108*a*, 108*b* formed in the first spring block portion 89 of the spring blocks 84, 86. The first and second spring block connection teeth 1061, 106*b*, 108*a*, 108*b* allow for easy and repeated removal and reconnection of the resistance assembly 45 from and to the handles 42, 44, respectively.

In a most particular example, the first and second spring block connection teeth 1061, 106*b*, 108*a*, 108*b* selectively cooperate with a plunger 90, 92 (see FIGS. 5, 6, 9*a*, 11*a*-11*c*, and 13-14) to selectively secure the resistance assembly 45 to the handles 42, 44. The plunger 90, 92 is disposed in a cavity 107, 109 formed second housing portion 52, 54, with a plunger spring 110, 112 (see FIGS. 5, 6, 9*b*, and 11*e*) also disposed in the cavity 107, 109 below the plunger 90, 92, as shown in FIG. 12. When assembled, and as shown in FIG. 5, a top portion of the plunger 90, 92 is also disposed through a hole 114, 116 formed in the first housing portion 48, 50, and is biased upwardly by the plunger spring 110, 112 to a default position.

Where a downward force is manually applied to the top portion of the plunger 90, 92, and the plunger 90, 92 is in a depressed position (see FIG. 14), the plunger spring 110, 112 is compressed and plunger teeth 100*a*, 100*b*, 102*a*, 102*b* are moved downwardly with the plunger 90, 92 into the cavity 107, 109. In particular, as shown in FIGS. 12-14, the cavity 107, 109 is in communication with a slot 111, 113 that receives one of the plunger teeth 100*a*, 100*b*, 102*a*, 102*b* when in the depressed position. The receipt by the slot 111, 113 of one of the spaced apart plunger teeth 100*a*, 100*b*, 102*a*, 102*b* defines a gap G, as shown in FIG. 14, which permits a sliding of the corresponding teeth 106*a*, 106*b*, 108*a*, 108*b* on respective spring blocks 84, 86 either in or out of the handles 42, 44.

Where no downward force is manually applied to the plunger 90, 92, and the plunger 90, 92 is in the default position (see FIG. 13), the gap G is not formed so that removal or reconnection of the grip assemblies 42, 44 to the resistance assembly 45 is militated against. In other words, when the plunger 90, 92 is not manually pressed and is biased in the default position, the plunger teeth 100*a*, 100*b*, 102*a*, 102*b* function to block the corresponding teeth 106*a*, 106*b*, 108*a*, 108*b* on respective spring blocks 84, 86 from sliding, thereby firmly securing the spring blocks 84, 86 to the handles 42, 44. This allows for removal or reconnection of the handles 42, 44 to the resistance assembly 45, as desired.

The above described exercise device 40, as assembled, provides a variable resistance and tension, which is created along the resistance assembly 45 by the user attempting to bend the resistance assembly 45. The resistance assembly 45 such as the coiled spring 46 resists bending, as each of the handles 42, 44 are moved proximate one another by the user. This resistance of the resistance assembly 45 to bending, together with resistance of the grip springs 72, 74 to compression, provides a conveyance of exercise to the user's muscles.

In operation, when the user rotates the grip body 68, 70 to cause the grip spring 72, 74 to compress, the muscles in each hand and arm are exercised, which results in a conveyance of exercise to other muscles of the body. A multitude of exercises, including those that consider "The Serape Effect," may be employed with the exercise device 40 operated thusly. The exercise device 40 has been found suitable to exercise all of the major muscle groups PM, SA, EO, IO, TA, and FA of the body.

Advantageously, with the exercise device 40 of the present disclosure, the user experiences complete motion and movement of the user's shoulder blades around the ribcage and across to the midline of the trunk. Thereby, all six of the user's major muscle groups PM, SA, EO, IO, TA, and FA are exercised by thorough and direct resistance to at least these primary muscle groups. This further improves a user's postural stability, along with performance, and prevention of injury, illness, or disease.

While certain representative embodiments and details have been shown for purposes of illustrating the invention, it will be apparent to those skilled in the art that various changes may be made without departing from the scope of the disclosure, which is further described in the following appended claims.

What is claimed is:

1. An exercise device, comprising:

a pair of handles including a first handle and a second handle, each of the first handle and the second handle having an annular grip housing with a top housing portion and a bottom housing portion; and a resistance assembly configured to provide a resistance to bending, the resistance assembly having a first end and a second end, the first end removably connected to the first handle and the second end removably connected to the second handle, wherein the resistance assembly includes a coiled spring and a pair of spring blocks including a first spring block and a second spring block, the first spring block disposed at a first end of the coiled spring and the second spring block disposed at the second end of the coiled spring, wherein each of the spring blocks has a first spring block portion and a second spring block portion, the first spring block portion oriented along a first axis and the second spring block portion oriented along a second axis, the first axis different from the second axis, and wherein the first block portion of each of the spring blocks has a pair of spaced apart connection teeth.

2. The exercise device of claim 1, wherein each of the top and bottom housing portions has a contoured inner surface, the contoured inner surfaces defining an internal annular channel therebetween.

3. The exercise device of claim 2, wherein the contoured inner surfaces of each of the top and bottom housing portions has a semi-circular wall, and each of the semi-circular walls is aligned to define a stop wall within the annular channel.

4. The exercise device of claim 3, wherein each of the first handle and the second handle has a grip body and a grip spring.

5. The exercise device of claim 4, wherein each of the grip body and the grip spring are disposed in the annular channel.

6. The exercise device of claim 5, wherein the stop wall has a first side and a second side, and the grip spring is disposed between the grip body and the first side of stop wall and normally biasing the grip body toward the second side of the stop wall.

7. The exercise device of claim 4, wherein the grip body has a semi-annular portion, a grip portion, and a bridge portion.

8. The exercise device of claim 7, wherein the semi-annular portion abuts the grip spring, and the grip portion extend across the diameter of the semi-annular portion.

9. The exercise device of claim 8, wherein the bridge portion has a width that is less than a width of the semi-annular portion, and the bridge portion is disposed adjacent the grip spring.

10. The exercise device of claim 4, wherein the grip spring has a PTFE coating.

11. The exercise device of claim 1, wherein the bottom housing portion has a cavity containing a plunger spring and a plunger, the plunger spring biasing the plunger upwardly from the bottom housing in a default position, the plunger configured to be manually moved to a depressed position by application of a force to the plunger to compress the plunger spring.

12. The exercise device of claim 11, wherein the cavity is in communication with a slot further formed in the bottom housing portion.

13. The exercise device of claim 12, wherein the plunger has spaced apart plunger teeth formed on a side of the plunger.

14. The exercise device of claim 13, wherein one of the plunger teeth is disposed in a gap adjacent the slot where the plunger is in the default position and thereby militates against a movement of the connection teeth of the spring block through the gap, and the one of the plunger teeth is disposed in the slot and not in the gap where the plunger is in the depressed position and thereby permits the movement of the connection teeth of the spring block through the gap, whereby each of the handles is secured to the resistance assembly where the plunger is in the default position and may be removed from the resistance assembly where the plunger is in the depressed position.

15. An exercise device, comprising:

a pair of handles including a first handle and a second handle, each of the first handle and the second handle having an annular grip housing with a top housing portion and a bottom housing portion; and a resistance assembly configured to provide a resistance to bending, the resistance assembly having a first end and a second end, the first end removably connected to the first handle and the second end removably connected to the second handle, wherein the resistance assembly includes a coiled spring and a pair of spring blocks including a first spring block and a second spring block, the first spring block disposed at a first end of the coiled spring and the second spring block disposed at the second end of the coiled spring, wherein each of the spring blocks has a first spring block portion and a second spring block portion, the first spring block portion oriented along a first axis and the second spring block portion oriented along a second axis, the first axis different from the second axis, and wherein each of the first end of the coiled spring and the second end of the coiled spring has a free end, and the free end is disposed in a spring block hole formed in one of the first spring block and the second spring block to secure the coiled spring to the one of the first spring block and the second spring block.

16. An exercise device, comprising:

a pair of handles including a first handle and a second handle, each of the first handle and the second handle having an annular grip housing with a top housing portion and a bottom housing portion, each of the top and bottom housing portions having a contoured inner surface, the contoured inner surfaces defining an internal annular channel therebetween, the contoured inner surfaces of each of the top and bottom housing portions having a semi-circular wall, and each of the semi-circular walls is aligned to define a stop wall within the annular channel, each of the first handle and the second handle further having a grip body and a grip spring, each of the grip body and the grip spring disposed in the annular channel, the stop wall having a first side and a second side, and the grip spring disposed between the grip body and the first side of stop wall and normally biasing the grip body toward the second side of the stop wall; and a resistance assembly configured to provide a resistance to bending, the resistance assembly having a first end and a second end, the first end removably connected to the first handle and the second end removably connected to the second handle, the resistance assembly further including a coiled spring and a pair of spring blocks including a first spring block and a second spring block, the first spring block disposed at a first end of the coiled spring and the second spring block disposed at the second end of the coiled spring, each of the spring blocks having a first spring block portion and a second spring block portion, the first spring block portion oriented along a first axis and the second spring block portion oriented along a second axis, the first axis different from the second axis, the first block portion of each of the spring blocks having a pair of spaced apart connection teeth, and the bottom housing portion having a cavity containing a plunger spring and a plunger, the plunger spring biasing the plunger upwardly from the bottom housing in a default position, the plunger configured to be manually moved to a depressed position by application of a force to the plunger to compress the plunger spring, the cavity in communication with a slot further formed in the bottom housing portion, the plunger further having spaced apart plunger teeth formed on a side of the plunger, wherein one of the plunger teeth is disposed in a gap adjacent the slot where the plunger is in the default position and thereby militates against a movement of the connection teeth of the spring block through the gap, and the one of the plunger teeth is disposed in the slot and not in the gap where the plunger is in the depressed position and thereby permits the movement of the connection teeth of the spring block through the gap, whereby each of the handles is secured to the resistance assembly where the plunger is in the default position and may be removed from the resistance assembly where the plunger is in the depressed position.

17. A kit for an exercise device, comprising:

a pair of handles including a first handle and a second handle, each of the first handle and the second handle having an annular grip housing with a top housing portion and a bottom housing portion; and a plurality of different resistance assemblies configured to provide a resistance to bending, each of the resistance assemblies having a first end and a second end, the first end configured to be removably connected to the first handle and the second end configured to be removably connected to the second handle, wherein each of the resistance assemblies includes a coiled spring and a pair of spring blocks including a first spring block and a second spring block, the first spring block disposed at a first end of the coiled spring and the second spring block disposed at the second end of the coiled spring, wherein each of the spring blocks has a first spring block portion and a second spring block portion, the first spring block portion oriented along a first axis and the second spring block portion oriented along a second axis, the first axis different from the second axis, and wherein the first block portion of each of the spring blocks has a pair of spaced apart connection teeth.

18. A kit for an exercise device, comprising:

a pair of handles including a first handle and a second handle, each of the first handle and the second handle having an annular grip housing with a top housing portion and a bottom housing portion; and a plurality of different resistance assemblies configured to provide a resistance to bending, each of the resistance assemblies having a first end and a second end, the first end configured to be removably connected to the first handle and the second end configured to be removably connected to the second handle, wherein each of the resistance assemblies includes a coiled spring and a pair of spring blocks including a first spring block and a second spring block, the first spring block disposed at a first end of the coiled spring and the second spring block disposed at the second end of the coiled spring, wherein each of the spring blocks has a first spring block portion and a second spring block portion, the first spring block portion oriented along a first axis and the second spring block portion oriented along a second axis, the first axis different from the second axis, and wherein each of the first end of the coiled spring and the second end of the coiled spring has a free end, and the free end is disposed in a spring block hole formed in one of the first spring block and the second spring block to secure the coiled spring to the one of the first spring block and the second spring block.

* * * * *